United States Patent [19]

Terunuma et al.

[11] Patent Number: 5,025,869

[45] Date of Patent: Jun. 25, 1991

[54] IMPACT DRILL

[75] Inventors: Yukio Terunuma, Hitachi; Takao Tanabe, Katsuta, both of Japan

[73] Assignee: Hitachi Koki Company, Limited, Japan

[21] Appl. No.: 414,547

[22] Filed: Sep. 29, 1989

[30] Foreign Application Priority Data

Sep. 30, 1988 [JP] Japan ..... 63-248586

[51] Int. Cl.[5] ..... B25D 15/02

[52] U.S. Cl. ..... 173/98; 173/109; 173/123; 173/104

[58] Field of Search ..... 173/104, 109, 122, 123, 173/98; 279/19.6, 19.1, 30

[56] References Cited

U.S. PATENT DOCUMENTS

| | | | |
|---|---|---|---|
| 2,500,402 | 3/1950 | Craig | 173/109 |
| 3,486,569 | 12/1969 | Sieber | 173/98 |
| 4,114,699 | 9/1978 | Wolf | 173/109 |
| 4,529,044 | 7/1985 | Klueber et al. | 173/109 |
| 4,732,217 | 3/1988 | Bleicher et al. | 173/104 |
| 4,770,254 | 9/1988 | Kominami | 173/109 |

FOREIGN PATENT DOCUMENTS

| | | | |
|---|---|---|---|
| 1438082 | 3/1966 | France | 173/98 |

*Primary Examiner*—Hien H. Phan
*Assistant Examiner*—Scott A. Smith
*Attorney, Agent, or Firm*—Lowe, Price, LeBlanc, Becker & Shur

[57] ABSTRACT

A power-driven impact drill includes a spindle extending at a right angle to the axis of rotation of a drill bit, a rotational first hammer slidably mounted on the spindle for co-rotation therewith, and a reciprocal second hammer slidably disposed in front of the drill bit. When the rotation of the first hammer is arrested by the second hammer, the first hammer is caused by a cam mechanism to retract along the spindle in a direction away from the second hammer against the force of a first hammer spring. Upon disengagement with the second hammer, the first hammer is permitted by the cam mechanism to slide back into engagement with the second hammer under the force of the first hammer spring while it is rotated by the spindle. In this instance, the angular velocity of the first hammer received by the spindle is enhanced by the force stored in the compressed first hammer spring so that a large impact power is imposed to the rotating drill via the second hammer without substantial loss.

10 Claims, 4 Drawing Sheets

IMPACT DRILL

BACKGROUND OF THE INVENTION

1. Field of the Invention

The present invention relates generally to a power tool, and more particularly to an impact drill having an impact mechanism for delivering a rapid succession of axial blows to a rotating drill bit.

2. Prior Art

Various impact drills are known in which an impact mechanism includes a motion translation means such as a crank mechanism for translating a rotary motion of an electric motor to a linear reciprocating motion of a piston. The piston is connected to a crank arm via a connecting rod and reciprocates in a cylinder to produce compressed air which in turn works a striker to move to and fro to strike the upper end of a rotating drill bit.

The known impact drills of the foregoing construction involve a great mechanical loss partly because various seals such as O-rings must be provided to seal the compressed air against leakage from the interface between movable members such as the piston and the striker, and stationary members such as the cylinder and a striker housing. A further mechanical loss is produced when the rotary motion is translated into the linear reciprocating motion. In a rotational power transmitting system of the known impact drills, the cylinder and the piston and other parts disposed in the cylinder are rotated in unison to transmit the rotary motion to the drill bit. This arrangement requires a large-sized bearing for the cylinder and hence the rotational power transmitting system is large in size and heavy in weight. In order to accommodate the great mechanical loss, it is necessary to increase the motor size which however results in an enlargement of the overall size of the impact drill. Further, the impact drill having the pneumatic impact power transmitting system is relatively long and hence uneasy to handle.

SUMMARY OF THE INVENTION

With the foregoing drawbacks in view, it is an object of the present invention to provide an impact drill which involves only a negligible amount of mechanical loss and is compact in size and right in weight and hence handy to use.

In brief, the present invention contemplates a power-driven impact drill which includes a impact power transmitting system including a rotational first hammer and a reciprocal second hammer adapted to be struck by the first hammer to translate the rotational energy of the first hammer into a succession of axial blows which in turn is delivered to a rotating drill bit. The first hammer is mounted on a spindle extending at a right angle to the axis of the drill bit so that the overall length of the impact drill is relatively small.

More particularly, a power-driven impact drill according to the present invention comprises: a drill bit holding portion including a rotatable hollow cylindrical bit holder releasably holding therein a drill bit which has at least one peripheral groove extending parallel to a longitudinal axis thereof. A steel ball is held on the bit holder and is releasably engageable with the peripheral groove of the drill bit to couple the bit holder and the drill bit while allowing axial movement of the drill bit within a limited extent equal to the length of the peripheral groove. A ball holder is slidably fitted over the bit holder for holding the steel ball against detachment from the bit holder. A rotational power transmitting system is operatively connected with the bit holder for rotating the bit holder and the drill bit in unison. An impact power transmitting system includes a spindle driven by the rotational power transmitting system and extending at a right angle to a longitudinal axis of the bit holder. A first hammer is slidably mounted on the spindle for co-rotation therewith and movable along the spindle between an operative position and an inoperative position remote from the operative position, the first hammer being urged by a first hammer spring into the operating position. The first hammer has at least one hammering head alignable with the longitudinal axis of the bit holder when the first hammer is disposed in the operative position. A second hammer is slidably mounted in the bit holder in end-to-end confrontation to the drill bit and movable to engage the hammering head for arresting rotation of the first hammer when the drill bit is forced rearward. A second hammer spring urges the second hammer in a direction away from the hammering head. A cam means acts between the spindle and the first hammer for causing the first hammer to slide along the spindle toward the inoperative position against the force of the first hammer spring when the rotation of the first hammer is arrested by the second hammer. Upon detachment of the hammering head from the second hammer, the cam means permits the first hammer to slide back to the operative position under the force of the first hammer spring while the first hammer is rotating together with the spindle, whereby the hammering head strikes the second hammer to thrust the rotating drill bit forward. In this instance, the angular velocity of the first hammer received by the spindle is enhanced by the force stored in the compressed first hammer spring so that a large impact power is imposed to the rotating drill via the second hammer without substantial loss. The impact power transmitting system of the foregoing construction involves only a negligible mechanical loss and hence requires only a small-sized drive motor.

According to a preferred embodiment, the cam means comprises at least one recess defined in an inner peripheral surface of the first hammer and having a first spiral cam surface having a lead angle, a spiral groove formed in an outer peripheral surface of the spindle and having a second spiral cam surface having the same lead angle as the first spiral cam surface, and a steel ball movably received between the recess and the groove and rollingly engageable with the first and second spiral cam surfaces. The spiral groove preferably has a semicircular cross-sectional shape.

The above and other objects, features and advantages of the present invention will become more apparent from the following description when making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The present invention will be described hereinbelow in greater detail with reference to a certain preferred embodiment shown in the accompanying drawings.

Figure 1:
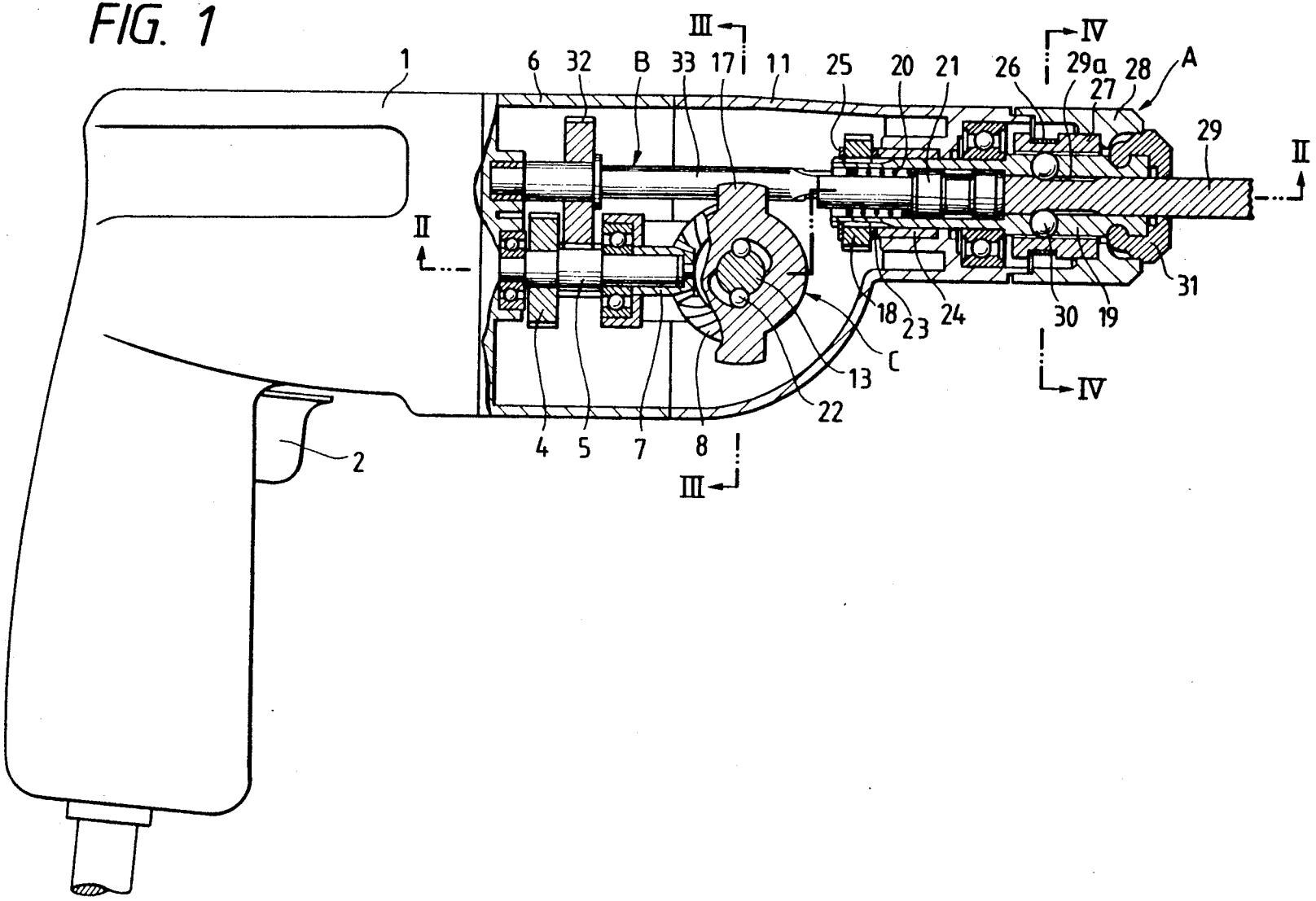
FIG. 1 is a fragmentary cross-sectional view of an impact drill according to the present invention taken along line I—I of FIG. 2.

As shown in FIG. 1, an impact drill according to the present invention generally comprises a drill bit holding portion A, a rotational power transmitting system B, and an impact power transmitting system C including an impact mechanism, all the components A, B, C being driven by an electric motor, not shown, disposed in a motor housing 1 when a trigger switch 2 is actuated to energize the motor. The impact drill further includes a hollow cylindrical inner cover 6 connected at its one end to the front end of the motor housing, and a gear cover 11 connected to the other end of the inner cover 6.

Figure 4:
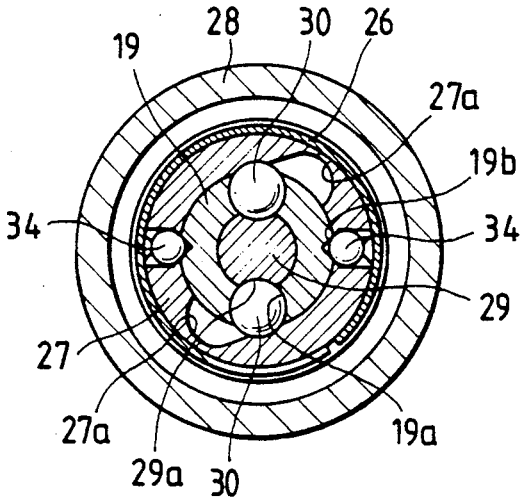
FIG. 4 is a cross-sectional view taken along line IV—IV of FIG. 1.

The drill bit holding portion A includes a hollow cylindrical bit holder 19 rotatably mounted on the gear cover 11 by means of a ball bearing (not designated) and a sleeve bearing 24 and having an axial central hole for receiving therein the shank of a drill bit 29, a pair of steel balls 30 received in a pair of diametrically opposite radial holes 19*a* (FIG. 4), respectively, in the bit holder 19 and releasably engageable with diametrically opposite peripheral grooves 29*a* in the drill bit 29 to couple the drill bit 29 and the bit holder 19, and a ball holder 27 slidably fitted over the bit holder 19 for holding the steel balls 30. The bit holder 19 is integral with a front cap 31 so that when the front cap 31 is turned, the bit holder 19 is angularly movable relative to the ball holder 27 between a locking position in which the steel balls 30 are urged by an inner peripheral surface of the ball holder 27 into the respective peripheral grooves 29*a* in the drill bit 29 to thereby couple the drill bit 29 and the bit holder 19, as shown in FIG. 4, and a releasing position in which the steel balls 30 are allowed to retract radially outwardly from the peripheral grooves 29*a* and enter into arcuate recesses 27*a* in the inner peripheral surface of the ball holder 27, thereby uncoupling the drill bit 29 and the bit holder 19. To hold the bit holder 19 and the ball holder 27 in the locking position, there is provided a pair of detent mechanisms each composed of a steel ball received in one of two diametrically opposite radial holes in the ball holder 27, a notch 19*b* formed in an outer peripheral surface of the bit holder 19, and a split ring spring 26 fitted over the ball holder 27 to urge each steel ball 34 into engagement with the corresponding notch 19*b*. The split ring spring 26 is resiliently expandable by the steel balls 34 when the steel balls 34 are forced radially outwardly as the bit holder 19 moves between the locking position and the releasing position relative to the ball holder 27 for locking and releasing the drill bit 29. The peripheral grooves 29*a* of the drill bit 29 extend longitudinally of the drill bit 29 over a certain extent for a reason described below. The drill bit holding portion A further includes a grip ring 28 fitted over the ball holder 27 for locking the same.

The rotational power transmitting system B is composed of a spur gear train rotatably held on the inner cover 6 and the gear cover 11. The spur gear train includes a first pinion 3 (FIG. 2) driven by the motor, a first spur gear 4 held in driven mesh with first pinion 3, a second pinion 5 coaxial with and rotatable in unison with the first spur gear 4, a second spur gear 32 held in driven mesh with the second pinion 5, a third pinion 33 coaxial with and rotatable in unison with the second spur gear 32, and a final spur gear 18 connected by spline fitting to an inner end of the bit holder 19 which is connected to the drill bit 29 via the steel balls 30. Designated by 23 is a washer disposed between an end of the sleeve bearing 24 and the final gear 18, and by 25 a stop ring attached to the inner end of the bit holder 19 to prevent removal of the final gear 18. With the rotational power transmitting system B thus constructed, a rotary motion and a rotational power are transmitted to the drill bit 29 through the gear train 4, 5, 32, 33, 18 and the ball-and groove coupling 30, 29*a*.

Figure 2:
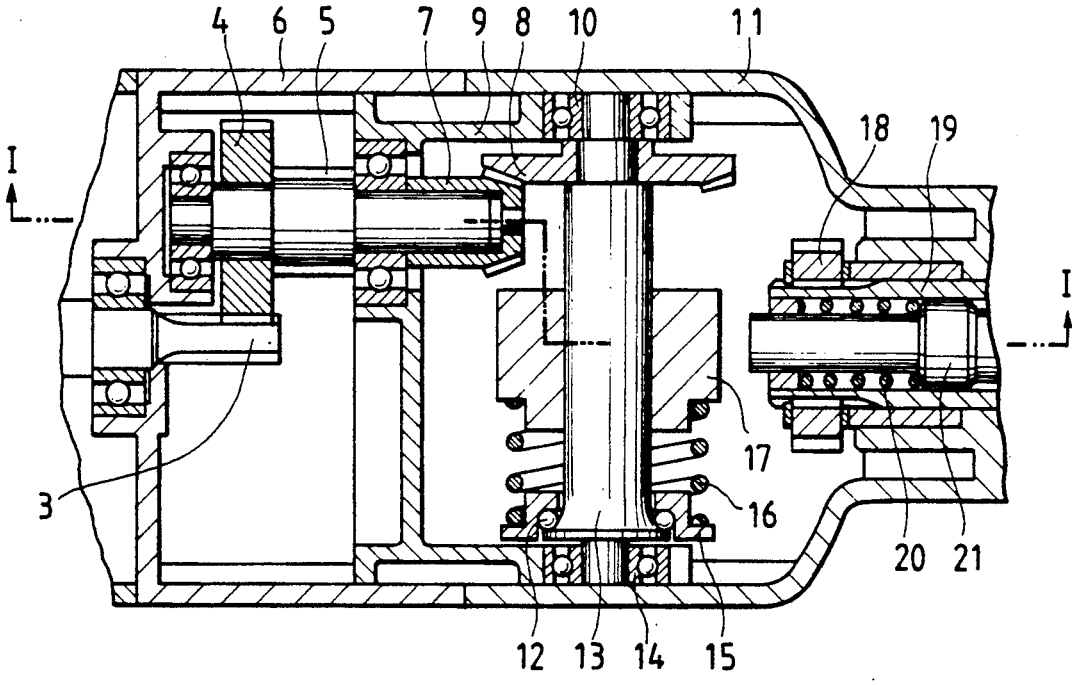
FIG. 2 is a cross-sectional view taken along line II—II of FIG. 1.
Figure 3:
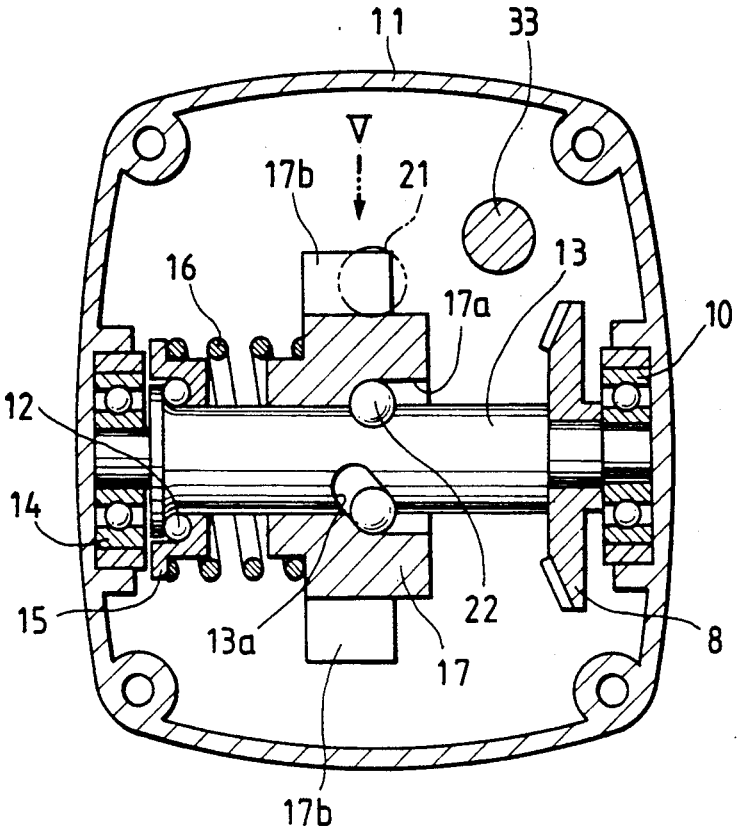
FIG. 3 is a cross-sectional view taken along line III—III of FIG. 1.

The impact power transmitting system C includes a first bevel gear 7 coaxial with and rotatable in unison with the second pinion 5, and a second bevel gear 8 having a much larger diameter than the first bevel gear 7 and held in driven mesh with the first bevel gear 7, the second bevel gear 8 being firmly secured to a spindle 13. The spindle is rotatably supported by a pair of ball bearings 10, 14 (FIGS. 2 and 3) mounted on a hammer holder 9 secured to the gear cover 11. The spindle 13 extends at a right angle to the axis of rotation of the bevel gear 7 and the common axis of rotation of the bit holder 19 and the drill bit 29. Thus, the direction of a power transmission line extending from the rotational power transmission system B is rightangled by the intermeshing bevel gears 7, 8. The rotational power thus deflected in its transmission line is then transmitted to an impact mechanism. The impact mechanism generally comprises, as shown in FIGS. 2 and 3, a rotational first hammer 17, a cam means or mechanism, a first hammer spring 16, a reciprocal second hammer 21 and a second hammer spring 20.

Figure 7:
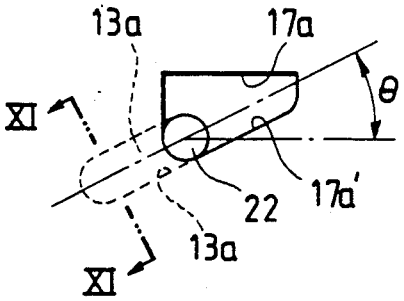
FIG. 7 is a developmental view showing a cam mechanism as it is in a first position corresponding to the position the first and second hammers shown in FIG. 5.

The first hammer 17 of the impact mechanism is slidably mounted on the spindle 13 and has a pair of diametrically opposite cam recesses 17*a* (FIG. 3) in its inner peripheral surface, and a pair of diametrically opposite hammering heads 17*b* projecting from an outer peripheral surface thereof. The hammering heads 17*b* are successively engageable with an inner end face of the second hammer 21 during drilling operation of the impact drill. Each of the cam recesses 17*a* has a spiral cam surface 17*a*' having a lead angle $\theta$, as shown in FIG. 7. The spindle 13 has in its outer peripheral surface a pair of diametrically opposite cam grooves 13*a* (FIG. 3) each having a second spiral cam surface 13*a*' having the same lead angle $\theta$ as the first cam surfaces 17*a*' of the rotational hammer 17, as shown in FIG. 7. Two steel balls 22 are movably received in respective pairs of confronting cam recesses and grooves 17*a*, 13*a* to slidably couple the first hammer 17 and the spindle 13. The cam recesses 17*a*, the cam grooves 17*a*, 13*a* and the steel balls 22 constitute the cam means stated above. The first hammer spring 16 comprises a compression coil spring loosely disposed around the spindle 13 and acts between the first hammer 17 and a spring seat 15 rotatably mounted on the spindle 13 adjacent to the ball bearing 14 by means of a plurality of steel balls 12. The first hammer spring 16 thus disposed urges the first hammer 17 in one direction until the steel balls 22 arrive at one end extremity of the second cam grooves 13*a*, as shown in FIG. 7. In this instance, the first hammer 17 is disposed in an operative position in which the hammering heads 17*b* are engageable with the second hammer 21 as described later.

Figure 5:
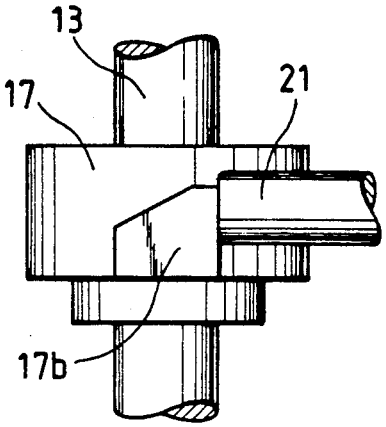
FIG. 5 is a view in the direction of the arrow V in FIG. 3, showing first and second hammers engaged together.
Figure 6:
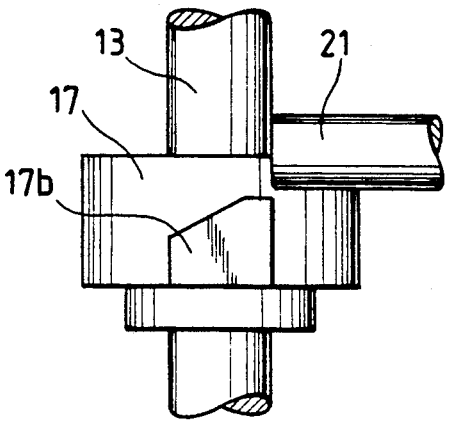
FIG. 6 is a view similar to FIG. 5, but showing the first and second hammers disengaged from one another.

The second hammer 21 is slidably received in the bit holder 19 and reciprocally movable along a path extending substantially tangentially to a circular path of movement of the center of the hammering heads 17*b* of the first hammer 17. The second hammer 21 is urged by the second hammer spring 20 toward an inner end of the drill bit 29. Thus, the second hammer 21 is normally held out of engagement with the first hammer 17. When a body of the impact drill is thrust toward a solid material such as a concrete, the drill bit 29 retracts or moves rearward relative to the impact drill body. This rearward movement of the drill bit 29 causes the second hammer 21 to slide along the bit holder 19 toward the first hammer 17 against the force of the second hammer spring 20 and then engage one of the hammering heads 17*b* to thereby temporarily arrest rotation of the first hammer 17, as shown in FIG. 5. The extent to which the second hammer 21 is movable is limited by the length of the peripheral grooves 29*a* of the drill bit 29, which length is determined such that the hammer heads 17*b* abuts flatwise against the inner end face of the second hammer 21.

The impact drill of the foregoing construction operates as follows.

When the trigger switch 2 is actuated, the motor is energized to drive the rotational power transmitting system B. While the motor is operating in non-load condition, the motor power or torque is transmitted successively through the spur gear train 3, 4, 5, 32, 33, 18 of the rotational power transmitting system B and the ball-and-groove coupling 30, 29*a* of drill bit holding portion A to the drill bit 29. The drill bit 29 is thus rotated continuously. At the same time, the motor torque is also transmitted through the bevel gears 7, 8 to the spindle 13 of the impact mechanism and rotates the spindle 13 and the first hammer 17 in unison. In this instance, the rotating first hammer 17 is held by the force of the first hammer spring 16 in the operative position in which the hammering heads 17*b* are alignable with the path of movement of the second hammer 21. However, the second hammer 21 is urged by the second manner spring 20 in a direction away from the hammering heads 17*b* of the rotating first hammer 17 so that an impact power is not transmitted to the rotating drill bit 29.

Figure 8:
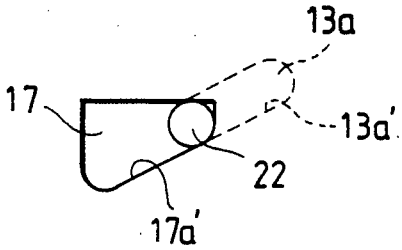
FIG. 8 is a view similar to FIG. 7, but showing the cam mechanism disposed in a second position corresponding to the position of the first and second hammers shown in FIG. 6.
Figure 9:
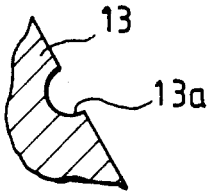
FIG. 9 is a cross-sectional view taken along line IX—IX of FIG. 7.

Then the tip end of the drill bit 29 is positioned at a desired position on a solid material such as a concrete, not shown, and the body of the impact drill is thrust down toward the concrete. This downward movement of the impact drill body causes the drill bit 29 to retract relative to the impact drill body with the result that the second hammer 21 is forced by the drill bit 29 to move against the force of the second hammer spring 20 toward a circular path of movement of the hammer heads 17*b* of the rotating first hammer 17. A continuous thrusting of the impact drill body (i.e. a continuous rearward movement of the drill bit 29) causes the inner end face of the second hammer 21 to engage one of the hammering heads 17*b* as shown in FIG. 5 and arrest rotation of the first hammer 17. In this instance, however, since the spindle 13 is continuously rotated by the motor, the first hammer 17 is retracted against the force of the first hammer spring 16 by the camming action caused by coaction of the spiral cam surfaces 17*a*', 13*a*' and the steel balls 22. During that time, the steel balls 22 rolls along the cam surfaces 13*a*' from a forward end (FIG. 7) toward a rear end (FIG. 8) of the cam recesses 13*a*. When the steel balls 22 is brought into the position of FIG. 8, the hammer head 17*b* is disengaged from the second hammer 21 whereupon the first hammer 17 resumes its rotational movement in unison with the spindle 13 while at the same time the first hammer 17 is thrust forwardly along the spindle 13 into its operative position under the force stored in the first hammer spring 16. Since this movement involves combined rotary and thrusting motions, the first hammer 17 possesses a rotational energy or torque equal to the sum of an angular velocity of the spindle 13 and an angular velocity created by the spring force stored in the compressed first hammer spring 16. Thus, the next following hammering head 17*b* strikes the inner end face of the second hammer 21 to thereby drive the rotating drill bit 29 forwardly against the concrete. In this instance, the hammering head 17*b* abuts flatwise against the inner end face of the second hammer 21 so that the impact power can be transmitted from the first hammer 17 to the second hammer 21 without loss. A single cycle of impacting operation is thus completed in which instance the second hammer 21 engages the hammering head 17*b* just struck the same, thereby again arresting rotation of the first hammer 17. So far as the impact drill body is thrust down toward the concrete, the first hammer 17 is again retracted, then rotated and propelled simultaneously, thereby hardly hitting the end face of the second hammer 21 by the next following hemmer head 17*b*. The foregoing cycle of operation is repeated until a desired hole is created in the concrete by a rapid succession of sharp blows imposed by the impact mechanism to the rotating drill bit 29.

As described above, the impact drill of the present invention, as opposed to the conventional impact drills employing a pneumatically reciprocating piston, uses a rotational hammer for delivering a rapid succession of axial blows to the rotating drill bit. The impact drill thus constructed does not involve substantial mechanical loss and power-transmission loss which would otherwise be caused by the movable components in a power transmitting system. Consequently, the impact drill can be driven only by a small-sized motor and hence is compact and lightweight as a whole. Furthermore, the rotational hammer is mounted on a spindle extending at a right angle to the axis of the drill bit so that the impact drill is small in length and easy to handle.

Obviously, various modifications and variations of the present invention are possible in the light of the above teaching. It is therefore to be understood that within the scope of the appended claimed the invention may be practiced otherwise than as specifically described.

What is claimed is:

1. A power-driven impact drill for use with a drill bit having at least one peripheral groove extending parallel to a longitudinal axis of the drill bit, comprising;

(a) a drill bit holding portion including a rotatable hollow cylindrical bit holder releasably holding therein a drill bit, at least one steel ball held on said bit holder and releasably engageable with the peripheral groove of the drill bit to couple said bit holder and the drill bit while allowing axial movement of the drill bit within a limited extent equal to the length of the peripheral groove, and a ball holder slidably fitted over said bit holder for holding said steel ball against detachment from said bit holder;

(b) a rotational power transmitting system operatively connected with said bit holder for rotating said bit holder and the drill bit in unison; and (c) an impact power transmitting system including a spindle driven by said rotational power transmitting system and extending at a right angle to a longitudinal axis of said bit holder, a first hammer slidably mounted on said spindle for co-rotation therewith and movable along said spindle between an operative position and an inoperative position remote from said operative position, said first hammer having at least one hammering head alignable with said longitudinal axis of said bit holder when said first hammer is disposed in the operative position, a first hammer spring urging said first hammer in said operative position, a second hammer slidably mounted in said bit holder in end-to-end confrontation to said drill bit and movable to engage said hammering head for arresting rotation of said first hammer when the drill bit is forced rearward, a second hammer spring urging said second hammer in a direction away from said hammering head, and cam means acting between said spindle and said first hammer for causing said first hammer to slide along said spindle toward said inoperative position against the force of said first hammer spring when the rotation of said first hammer is arrested by said second hammer, upon detachment of said hammering head from said second hammer, said cam means permitting said first hammer to slide back to said operative position under the force of said first hammer spring while it is rotating together with said spindle, whereby said hammering head strikes said second hammer to thrust the rotating drill bit forward.

2. A power-driven impact drill as claimed in claim 1, wherein said bit holder is angularly movable relatively to said ball holder between a locking position in which said steel ball is urged into the peripheral groove of the drill bit by said ball holder, and a releasing position in which said ball is allowed to retract from said peripheral groove of the drill bit.

3. A power-driven impact drill as claimed in claim 2, wherein said drill bit holding portion further includes means for releasably locking said bit holder in said locking position.

4. A power-driven impact drill as claimed in claim 3, wherein said locking means comprises a detect mechanism including a steel ball retained by said bass holder, a retaining recess formed in an outer periphery of said bit holder and receptive of said steel ball, and a spring means for urging said steel ball into said retaining recess.

5. A power-driven impact drill as claimed in claim 4, said spring means is a split ring spring fitted around said bass holder.

6. A power-driven impact drill as claimed in claim 1, wherein said rotational power transmitting system includes a gear train having a final gear splined to an end of said bit holder.

7. A power-driven impact drill as claimed in claim 1, wherein said impact power transmitting system includes a first bevel gear drivable by said rotational power transmitting system and a second bevel gear secured to said spindle and held in mesh with said first bevel gear.

8. A power-driven impact drill as claimed in claim 1, wherein said cam means comprises at least one recess defined in an inner peripheral surface of said first hammer and having a first spiral cam surface having a lead angle, a spiral groove formed in an outer peripheral surface of said spindle and having a second spiral cam surface having the same lead angle as said first spiral cam surface, and a steel ball movably received between said recess and said groove and rollingly engageable with said first and second spiral cam surfaces.

9. A power-driven impact drill as claimed in claim 8, wherein said spiral groove has a semicircular cross-sectional shape.

10. A power-driven impact drill as claimed in claim 1, wherein the number of said hammering head is two, said two hammering being disposed in diametrically opposite relation to one another.

* * * * *